US005403460A

United States Patent [19]

Sala et al.

[11] Patent Number: 5,403,460

[45] Date of Patent: Apr. 4, 1995

[54] METHOD AND APPARATUS FOR NICKEL ELECTRO-PLATING

[75] Inventors: Béatrice Sala, Jonzieux; Laurent Guerin, St-Just-Malmont; Bernard Michaut, Lyons, all of France

[73] Assignees: Framatome, Courbevoie; I.R.S.I.D. SNC, Puteaux, both of France

[21] Appl. No.: 5,207

[22] Filed: Jan. 15, 1993

[30] Foreign Application Priority Data

Jan. 16, 1992 [FR] France ..... 92 00407

[51] Int. Cl.[6] ..... C25D 17/00

[52] U.S. Cl. ..... 204/252

[58] Field of Search ..... 205/271; 204/252; C25D 3/12

[56] References Cited

U.S. PATENT DOCUMENTS 4,902,388 2/1990 Fornwalt et al. ..... 204/32.1

FOREIGN PATENT DOCUMENTS 4-17693 5/1990 Japan .

3-120390 5/1991 Japan .

OTHER PUBLICATIONS

Chemical Abstracts, vol. 102, No. 18, May 1985, Columbus Ohio, U.S. Abstract No. 156932R, Hitachi: "Nickel electroplating cell" p. 500; col. 2—Abstract—.

Patent Abstracts of Japan, vol. 5, No. 49 (C-49)(721) Apr. 8, 1981 & JP-A-56 003 692 (Kooken KK) Jan. 14, 1981—Abstract—.

*Primary Examiner*—John Niebling
*Assistant Examiner*—Edna Wong
*Attorney, Agent, or Firm*—Pollock, Vande Sande & Priddy

[57] ABSTRACT

An apparatus for nickel electro-plating parts from nickel plating baths that use nickel sulfamate as a source of nickel has a tank containing the nickel plating bath and in which an anode and a cathode are immersed. A semi-permeable wall of sintered or polymer material separates a cathode compartment from an anode compartment.

4 Claims, 2 Drawing Sheets

METHOD AND APPARATUS FOR NICKEL ELECTRO-PLATING

BACKGROUND OF THE INVENTION

The present invention relates to nickel electro-plating. It relates to the field of electro-plating of metal or non-metal parts with nickel by means of plating baths using nickel sulfamate as the nickel providing species.

An important application lies in internally nickel electro-plating hollow elements such as the tubes of a steam-generator, pressurizer nozzles, or adapters for the reactor vessel lid in a pressurized water nuclear power station, or any other tube used in the nuclear industry or elsewhere. Another important application lies in nickel plating electrical connector elements. However, it relates more generally to any nickel plating that makes use of a nickel sulfamate bath either by means of a static process (the bath being in a vessel having fixed electrodes), or by means of a dynamic process (the bath being caused to flow or the parts to be nickel-plated being moved).

The invention further relates to purifying nickel plating baths used for nickel plating.

It is known that nickel plating the inside zones in U-shaped tubes of a steam generator that are subjected to particularly severe stresses makes it possible to close microcracks or to prevent such cracking. As an example of a known nickel plating repair method, reference may be made to EP-A-0 167 513.

The apparatuses conventionally used for nickel electro-plating comprise:

- a receptacle containing the nickel plating bath, an anode often constituted by a screened basked (e.g., made of titanium) and filled with balls of sacrificial nickel (e.g., those sold by the firm INCO), and a cathode constituted by the part to be nickel plated; or
- the same or similar receptacle, nickel plating bath, and anode as above, but with a cathode constituted by a metal plate (e.g., stainless steel), with the entire apparatus then being used for preparing the nickel plating bath prior to use by purifying it to eliminate undesired metal impurities by controlled electrolysis (e.g., eliminating cobalt for nuclear installations); or
- a hollow cylindrical anode coated with sacrificial nickel and placed in the center of the tube to be repaired by nickel plating, which tube constitutes the cathode, the nickel plating bath following in one direction between the cathode and the anode and then the opposite direction inside the anode.

With the devices described above, complex compounds are formed during electrolysis, both on the cathode and on the anode, and can recombine freely with each other.

The term "complex compounds" is used to designate compounds that drive from a change in the sulfamate bond, such as azodisulfonate.

These complex compounds present problems during nickel plating which are generally manifested by the nickel anode being passivated, in particular because of the reduction on the cathode of oxygen compounds formed at the anode which unbalance the electrochemical system towards a potential where the anode becomes passivated, and/or by increase in the electromechanical resistance of the nickel plating cell due, in particular, to the presence of poorly ionized compounds, which leads to operation which is no longer under the conditions of current and voltage that are desirable for nickel plating, to coatings which no longer have the required quality, and/or rapid degradation of the nickel plating baths.

The abstract "Nickel electro-plating cell", Hitachi Ltd., Japan Kokai Tokyo Koho JP 59 193 295, page 500, col. 2, Chemical Abstracts, Vol. 102, No. 18, May 1985, describes a cell having a cation exchanging membrane permeable to Ni-ions for separating a Pt-coated anode and a cathode. There is no reference to a barrier other than a ion-exchanging membrane.

SUMMARY OF THE INVENTION

The present invention provides an apparatus for nickel electro-plating a part, having a tank containing a nickel sulfamate containing bath, an anode and a cathode bath immersed in said bath, and a semi-permeable wall separating a cathode compartment from an anode compartment, the semi-permeable wall being made of chemically inert sintered material or polymer material.

The semi-permeable wall prevents oxygen-containing compounds formed at the anode from passing into the cathode compartment from the anode compartment.

To forestall or prevent degradation of nickel plating baths and enable such baths to be used until their nickel content has been used up, without incidents due to early passivation of a sacrificial anode of nickel (or rather sulfur depolarized nickel, such as the products sold by INCO in the form of pellets, balls, etc.), there is provided a method wherein free exchanges between the complex compounds formed on the cathode and on the anode are prevented while still allowing the electrolysis current to flow, by separating the anode from the cathode by a semi-permeable wall of chemically inert sintered material or polymer material.

The cathode may be constituted by the part to be plated, which part is within the bath in the cathode compartment.

The method may further include a preliminary step—prior to nickel plating operation—including passing a current while the cathode is constituted by a simple electrode enabling electrolysis to be performed. Then degradation of the nickel plating bath is prevented, thus enabling the bath to be used until its nickel content has been used up.

The invention will be better understood from the following, now detailed description of a nickel electroplating apparatus of the invention.

DETAILED DESCRIPTION OF PREFERRED EMBODIMENTS

Figure 1:
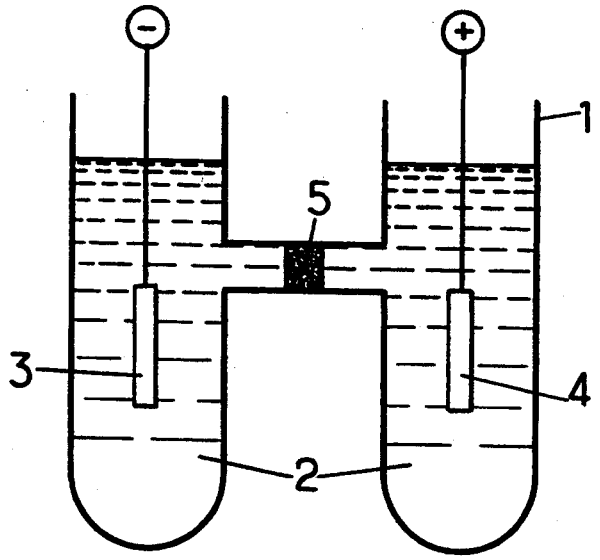
FIG. 1 and FIG. 2 show particular embodiments of the invention, given by way of example.

Referring to FIG. 1, a cell 1 comprises two vertical vessels in communication by means of a transverse channel and intended to receive an electrolysis bath 2. A cathode 3 is immersed in one of the vertical vessels and an anode 4 is immersed in the other vertical vessel. A semi-permeable wall 5 closes the transverse channel which interconnects the two vertical vessels, thereby separating an anode compartment from a cathode compartment.

Figure 2:
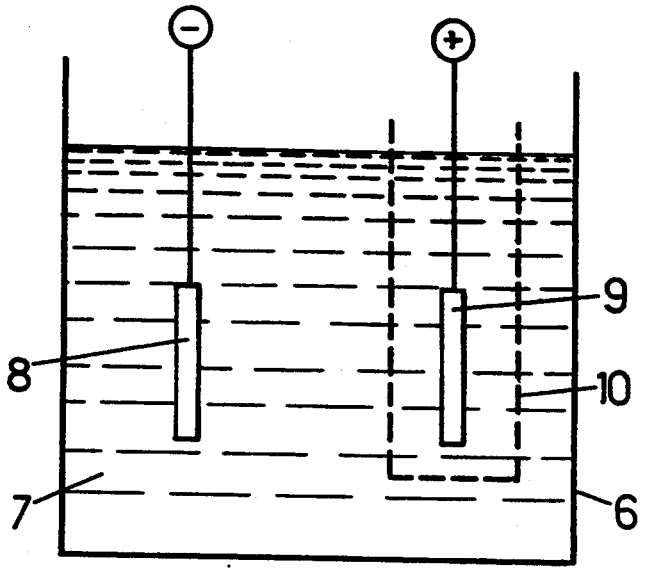

FIG. 2 is a schematic view of a cell having a tank 6 for receiving a bath 7 to be purified. In the bath, there are immersed a cathode 8 and an anode 9. A semi-permeable wall 10 defines an anode compartment around the anode within the nickel plating bath and separates the cathode from the remainder of the bath.

The semi-permeable wall device is of a sintered material or is a polymer membrane.

The disposition shown in FIG. 2 may be inverted, i.e., the cathode may be isolated from the remainder of the bath by a semi-permeable wall.

The electrolysis process is of a type known per se as regards the electric connections to the electrodes and monitoring of the various parameters.

For example, the anode and the cathode may be connected via a rheostat to terminals of a DC source capable of delivering a voltage U of a few volts and a current I of a few amps. A voltmeter may be connected between the anode and a reference electrode to indicate the potential (Ea) of the anode relative to the reference electrode.

In a currently used prior art nickel electro-plating apparatus, all three electrodes (cathode, anode and reference electrode) are placed in a common vessel.

Figure 3:
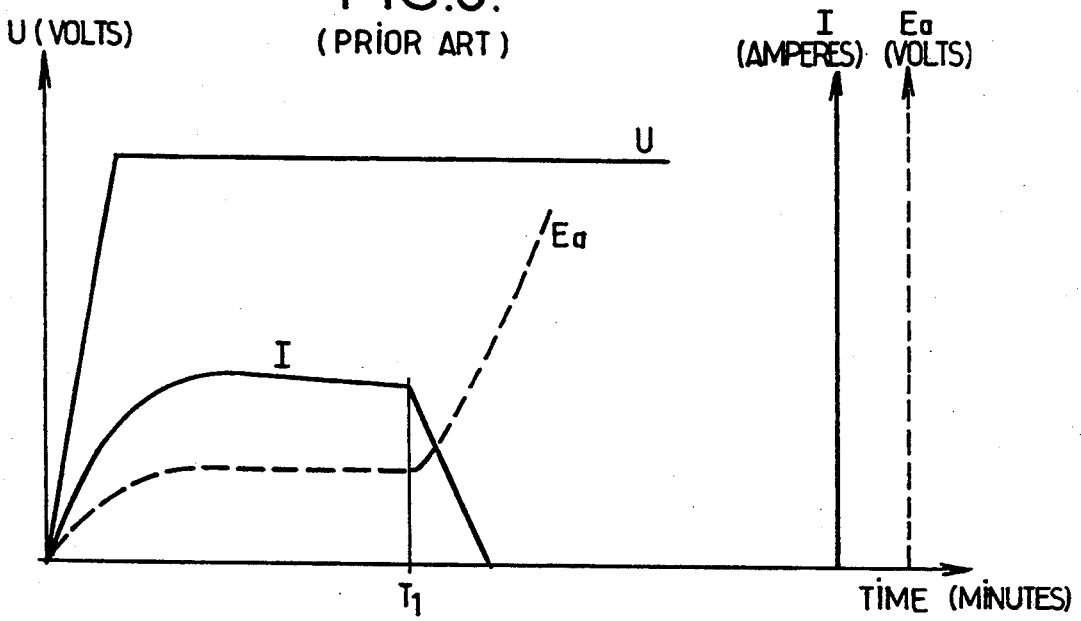
FIG.3. (PRIOR ART)
FIG. 3 is a representation of the time variation of electrochemical parameters during electrolysis as performed in the prior art.

Then, referring to FIG. 3, up to time $T_1$, the parameters I, U and Ea are constant and the electrolysis process takes place normally. After $T_1$, anode passivation is observed which not only increases the potential of the anode relative to the reference electrode Ea, but also causes a sudden drop in the nickel plating current I and rapid degradation of the bath due to oxidization and formation of a non-uniform nickel deposit. Such passivation of the anode also detrimentally affects the bath by acidification, with the consequence that a fragile deposit of nickel is formed.

The above description refers to electrolysis with a predetermined constant voltage U, but it also applies to electrolysis when current I is maintained constant. Under such circumstances, instead of a sudden drop in current I, a sudden rise in voltage U occurs, but the consequence on the bath and on the quality of the deposit is the same.

In an apparatus of the invention of the kind shown schematically in FIG. 1, the cathode is placed in one of the two vertical vessels while the anode and the reference electrode are placed in the other vertical vessel; the semi-permeable wall 5 is placed between the two vessels in the transverse channel.

Figure 4:
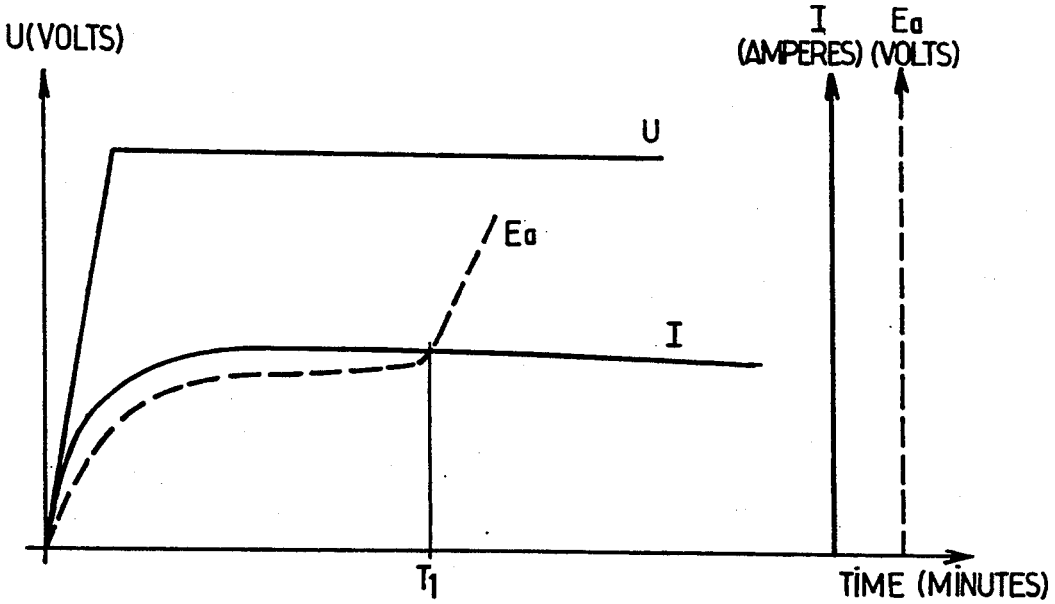
FIG. 4 is a representation of the time variation of electromechanical parameters during electrolysis performed in accordance with the invention.

FIG. 4 shows that, up to time $T_1$, electrolysis takes place in the same manner as in the previous case shown in FIG. 3. As in the previous case, anode passivation causes the potential Ea to rise. However, the important electrolysis parameters in the bath of nickel sulfamate are maintained, i.e., the current I and the potential U remain substantially constant.

The description remains valid regardless of whether electrolysis is performed under an imposed constant potential U or an imposed constant current I.

Consequently, neither the quality of the cathode bath nor the quality of the deposit are disturbed by possible passivation of the anode.

It will be understood that, due to the invention, it is now possible to use a non-consumable anode from the beginning of electrolysis, which was impossible in the prior art due to rapid degradation of parameters.

To evaluate the advantages provided by the invention, nickel plating operations have been performed, some in accordance with the prior art and others in compartments separated by sintered semi-permeable wall, while using two nickel plating baths of compositions that were initially identical.

In each nickel plating operation 120 $cm^3$ of a nickel plating water solution was prepared from:

93 grams per liter (g/l) of nickel in the form of sulfamate; and 40 g/l of boric acid;

The distance between the electrodes was8 cm; the electrodes were plates having the following dimensions: 1.4 cm×1.4 cm×0.1 cm; the cathode was made of "Inconel 600" alloy; the anode was made of nickel covered on one face with sulfur depolarized nickel.

Prior to nickel plating, the electrodes were subjected to electrolytic cleaning in 10% sulfuric acid at 58° C.:

for 60 seconds at a current of 32 $A/cm^2$ for the cathode;

for 25 seconds at a current of 32 $A/cm^2$ for the anode; and then washed in water, polarized in a sulfamic acid/nickel sulfamate medium at 58° C. for 30 seconds at a current of 4.8 $A/cm^2$ (the cathode being cathodically polarized).

The above-described electrodes and a reference electrode of mercurous sulfamate were placed in the bath of nickel sulfamate. During the nickel plating operation the bath of nickel sulfamate was electrolyzed using a voltage U that was kept constant after being raised linearly from 0 volts to U volts in one minute, so as to obtain a current density I under steady conditions lying in the range 20 $A/dm^2$ to 25 $A/dm^2$; the current density and the anode voltage (i.e., the potential Ea of the anode relative to the reference electrode) were recorded.

In the prior art electro-plating apparatus, all three electrodes (cathode, anode, and reference electrode made of mercurous sulfamate), were placed in the same vessel. In the apparatus of the invention, the cathode was placed in one of the two vertical vessels of a device of the kind shown schematically in FIG. 1, while the anode and the reference electrode were placed in the other vertical vessel, with the semi-permeable wall being a No. 4 Pyrex sintered material having a thickness of 3 mm, as sold by the firm SOVIREL and being placed between the two vessels in the transverse channel.

Results of electrolysis

In both cases, the total duration of the electrolysis was voluntarily fixed at 8½ hours.

With the single vessel, passivation of the anode occurred after about 30 minutes as shown by the rise in its surface potential from a value Ea equal to about 300 mV to a value greater than 1000 mV.

In this first case, during the 8½ hours of nickel plating, for a volume of 60 $cm^3$ of solution in the cathode compartment or for 5.6 grams of nickel present in the initial solution, 0.86 grams of nickel were deposited on the cathode, i.e., 15% of the nickel available in the solution; FIG. 3 shows how the electrochemical parameters varied.

In an apparatus in accordance with the invention, passivation as shown by the rise in anode potential took place after 40 minutes of nickel plating. However, the current density I remained stable and nickel plating continued to take place during the 8½ hours after which the test was voluntarily stopped. FIG. 4 shows how the electrochemical parameters varied.

In that case, for a volume of 60 $cm^3$ of solution in the cathode compartment or for 5.6 grams of nickel present in the initial solution, 4.4 grams of nickel were deposited on the cathode during the 8½ hours of nickel plating, i.e., 78% of the nickel available in the solution was deposited.

The advantages of the invention when used for purifying or regenerating the nickel plating bath will now be illustrated.

The above experiment was extended by the following two tests:

I. After the 8½ hours of electrolysis in the above experiments, the cathode compartment was emptied and filled with a new bath, and a new anode substituted for the original cathode. A new cathode was immersed in the original anode compartment in place of the original anode. The two compartments were thus swapped over. As soon as electrolysis was started, passivation of the anode placed in the new bath occurred.

II. After 8½ hours of electrolysis, the anode compartment was emptied and filled with a new bath together with a new cathode in the place of the original anode, the original cathode being replaced by a new anode which was thus immersed in the original cathode bath that had already been used for 8½ hours. In that case, on electrolysis, nickel plating continued for 30 minutes without passivation and the test was stopped voluntarily.

It can thus be seen that the initial nickel plating bath in one of the compartments was greatly enriched with complex compounds, such as azodisulfonate making electrolysis impossible, whereas the bath contained in the other compartment remained suitable for performing effective nickel plating after the original bath had been in use for nine hours.

Keeping the oxygen-containing compound in a special compartment so as to avoid polluting the whole bath makes it possible to purify baths of sulfamate by electrolysis (extracting traces of cobalt, for example) without polluting the baths with azodisulfonate.

We claim:

1. Nickel electro-plating apparatus comprising a tank receiving a nickel sulfamate-containing nickel plating bath, an anode and a cathode immersed in said bath, and a semi-permeable wall of chemically inert sintered material separating a cathode compartment from an anode compartment in said bath, wherein said semi-permeable wall of inert sintered material preventing oxygen-containing compounds from passing from the anode compartment to the cathode compartment.

2. Apparatus according to claim 1, wherein said semi-permeable wall defines said anode compartment around said anode while the balance of the bath between the tank and the wall constitutes said cathode compartment.

3. Apparatus according to claim 1, wherein said semi-permeable wall is of Pyrex sintered material.

4. Nickel electro-plating apparatus comprising a tank receiving a nickel sulfamate-containing nickel plating bath, an anode and a cathode immersed in sintered material or polymer separating a cathode compartment from an anode compartment in said bath, wherein said tank comprises two vertical vessels and a transverse channel communicating said two vessels and wherein the semi-permeable wall is placed in said channel.

* * * * *